United States Patent [19]

dos Santos Copia

[11] Patent Number: 4,692,134

[45] Date of Patent: Sep. 8, 1987

[54] MACHINE FOR MAKING UNITIZED STACKS OF BAGS

[75] Inventor: Carlos R. dos Santos Copia, Sao Paulo, Brazil

[73] Assignee: Maquinas NPU Ltda., Sao Paulo, Brazil

[21] Appl. No.: 870,881

[22] Filed: Jun. 5, 1986

[30] Foreign Application Priority Data

Sep. 17, 1985 [BR] Brazil ..... 8504518[U]

[51] Int. Cl.[4] ..... B31B 1/98; B31B 23/86

[52] U.S. Cl. ..... 493/196; 493/204

[58] Field of Search ..... 493/196, 204, 210, 226, 493/926, 206, 209, 189, 480; 156/515

[56] References Cited

U.S. PATENT DOCUMENTS

| | | | |
|---|---|---|---|
| 3,813,998 | 6/1974 | Lotto | 493/204 |
| 4,386,924 | 6/1983 | Crawford et al. | 493/196 |
| 4,487,599 | 12/1984 | Bendig et al. | 493/204 |
| 4,526,639 | 7/1985 | Reimann | 493/204 |
| 4,604,084 | 8/1986 | Pistner | 493/226 |

FOREIGN PATENT DOCUMENTS

| | | | |
|---|---|---|---|
| 2428599 | 2/1980 | France | 493/204 |

*Primary Examiner*—Frederick R. Schmidt
*Assistant Examiner*—William E. Terrell
*Attorney, Agent, or Firm*—Kimmel, Crowell & Weaver

[57] ABSTRACT

A machine for making a unitized stack of vest type bags from a tubular plastic web comprising, essentially, a horizontal frame (1) adjoining at one end a unit for unwinding the plastic film (2) in an intermediate portion supporting transversal rollers (3) and a cutter unit (4), the former for pulling the film (2) and the latter for cutting out the straps of the bags. At the opposite extremity of the frame (1) there is provided a sealing and cutter unit (5) at the outlet of which there is disposed a bundling and ejector unit (6) to accomplish the bundling of various bags for forming and ejecting blocks of bags. The bundling and ejector unit (6) has a sealing table (7) interposed between a tilting vane (8) and a tilting table (9). Sealing electrodes in the shape of pins (12) perform the sealing of various bags making up a block and alongside of which are needles (13) to stabilize the bags on the table (7). Both the sealing electrodes (12) and the needles (13) are seated on a support (14) capable of moving upwards or downwards. A corresponding depressing bar (15) is formed by a length of stock with a rectangular section with the surface thereof facing table (7). The depressing bar (15) is movable upwardly or downwardly to urge the plastic film (2) against the sealing electrodes (12) and stabilizing needles (13) and upon which a duct (18) is seated with various air-emitting nozzles (19) being turned toward the tilting vane (8) and which act in cooperation with the latter.

4 Claims, 4 Drawing Figures

MACHINE FOR MAKING UNITIZED STACKS OF BAGS

The object of the present patent is an improvement in a machine for manufacturing wrappers, these, more precisely, being obtained from plastic film, used as a package and in the form of bags of the vest type, supplied in blocks of various bags and the improvement being in the bundling unit of various bags for forming the blocks in predetermined quantities.

A package comprised by a vest-type bag is already known, this being formed by a section in the form of a sack, from the mouth of which extend gripping straps, all as a single part from plastic film molded into a tube.

This type of bag is normally supplied to the user, that is, the merchant who is going to pack his goods with same, in isolated units or in a plurality of units bundled through sealing and forming a block.

The machine manufacturing this type of wrapper is comprised, essentially, by a horizontal frame, which is provided, adjoining one of the extremities, with a unit for unwinding the plastic film, at the middle with rollers for pulling the film and with a cutter unit and, at the opposite extremity, provided with a sealing and cutter unit, so that, when the machine is designed to supply the wrappers in blocks, the bundling unit is provided at the outlet of the sealing and cutter unit.

The conventional construction of this latter unit leaves much to be desired due to a number of inconveniences, such as unsatisfactory performance and others.

In view of such inconveniences and for the purpose of overcoming them, an improvement in a machine for manufacturing wrappers was developed, which is the object of the present invention. This is accomplished, more precisely, in the bundling unit, which exhibits a design that is totally different from conventional ones, and is capable of solving the problems that occur with known type units.

The attached drawings illustrate the improvement in a machine for manufacturing wrappers, which is the object of the present invention, and in them:

Figure 1:
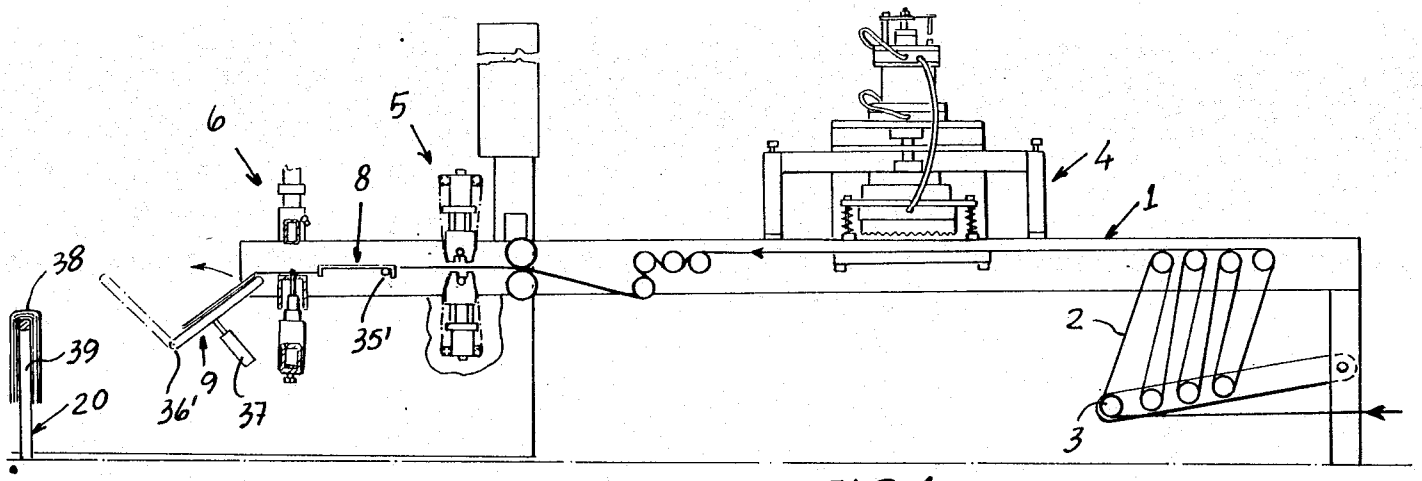
FIG. 1 is a side, partly schematic elevational view of the machine.
Figure 2:
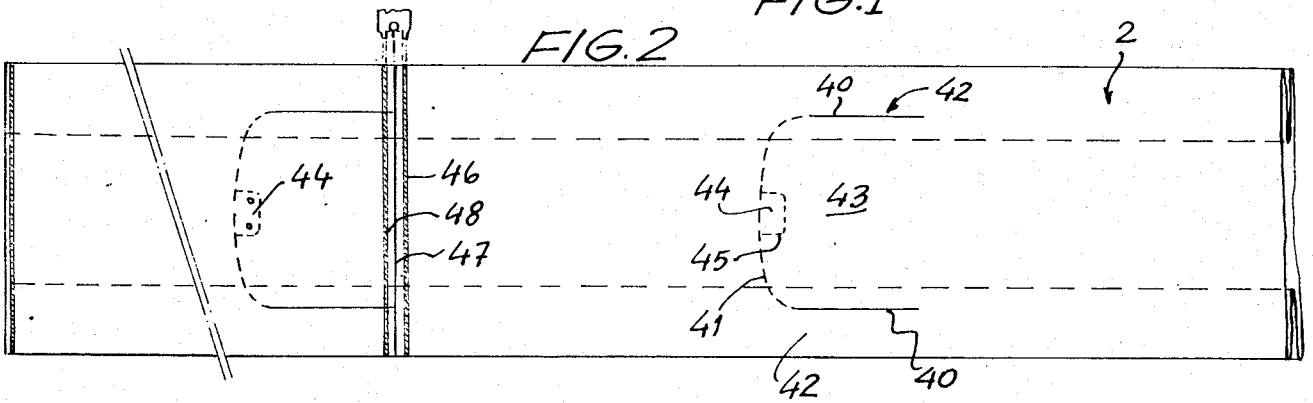
FIG. 2 is a plan view of a section of film depicting the sequence of operations for manufacturing the wrapper.

In accordance with what is illustrated in the aforementioned figures, the machine for manufacturing wrappers, the object of the present invention, manufactures wrappers from a plastic film molded into a tube, in the form of vest-type bags bundled into blocks with various units. The machine is comprised, essentially, by a horizontal frame 1, adjoining one of the extremities of which a unit for unwinding the plastic film is disposed (not illustrated), from which the film 2 to be processed is supplied. The structure 1 in the intermediate has portion supporting rollers 3 for tensioning the plastic film and a cutter unit 4, the latter for providing the cuts that give shape to the straps of the vest-type bag. A sealing area for bundling the bags is provided with a sealing and cutter unit 5 being disposed at the opposite extremity of the referenced frame 1 for performing the seals and cuts for closing and separating the various bags, at the outlet of which a bundling and ejector unit 6 is disposed, which accomplishes the bundling of a predetermined plurality of bags to be supplied to the users, thereafter ejecting the finished block from the machine for the remaining operations.

Figure 3:
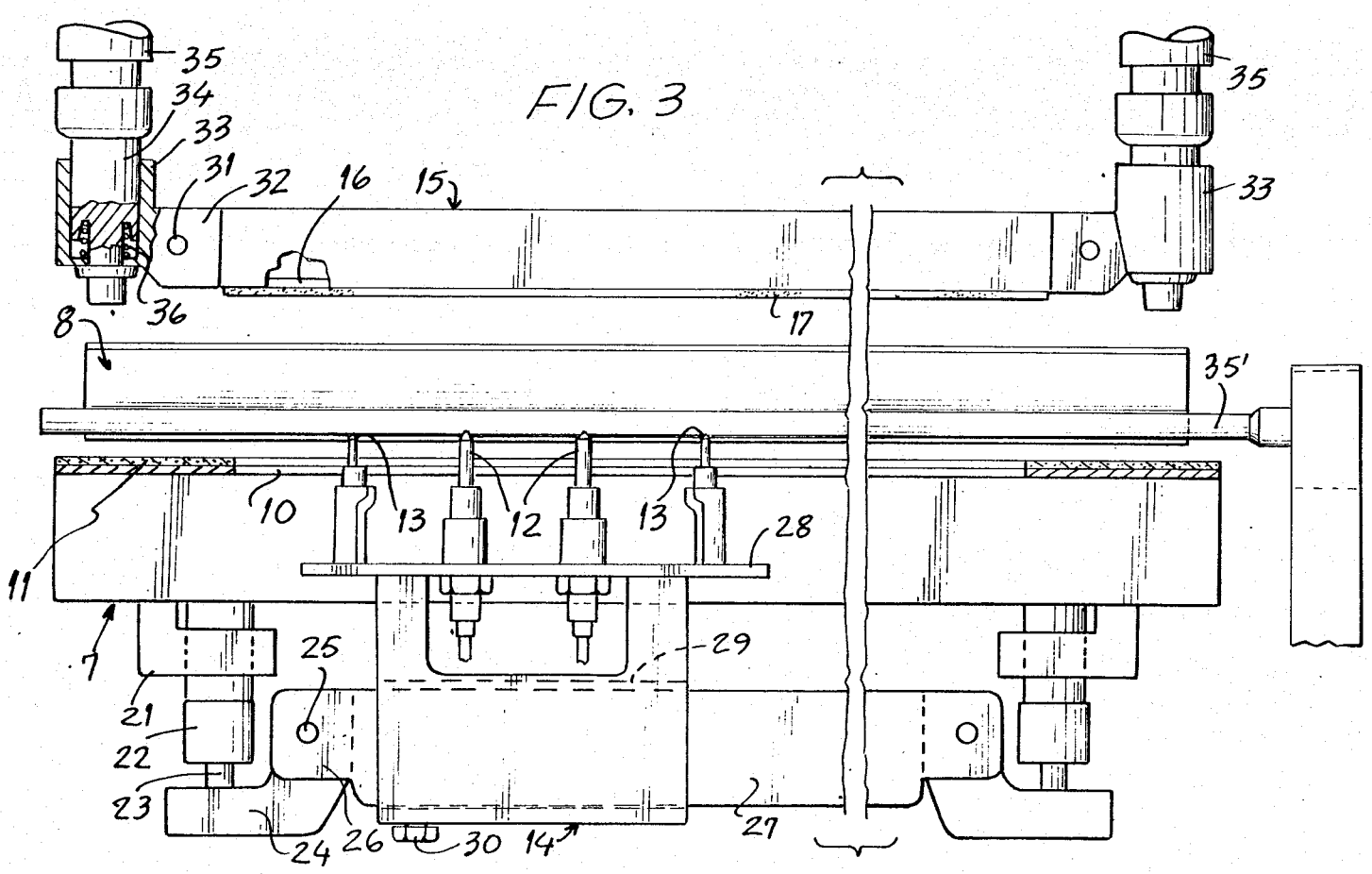
FIG. 3 is a front view of the bundling unit, according to the present invention.
Figure 4B:
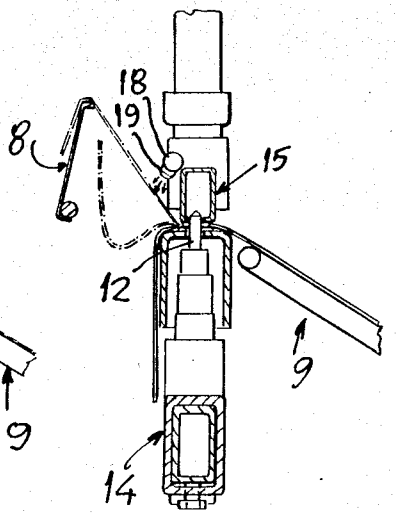
FIG. 4 is a section A—A indicated in the previous Fig. in various stages of operation a, b and c.
Figure 4A:
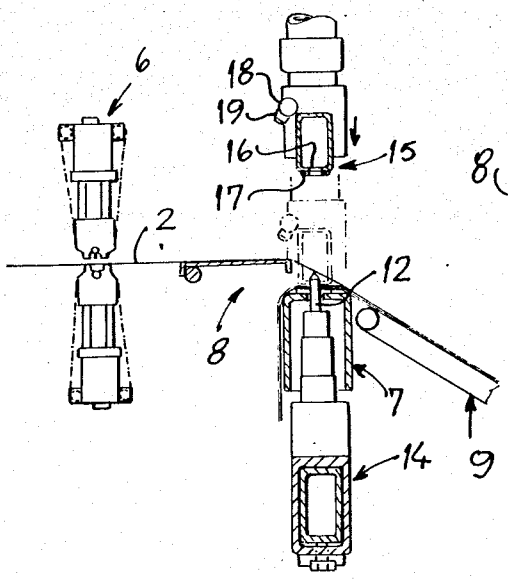
Figure 4C:
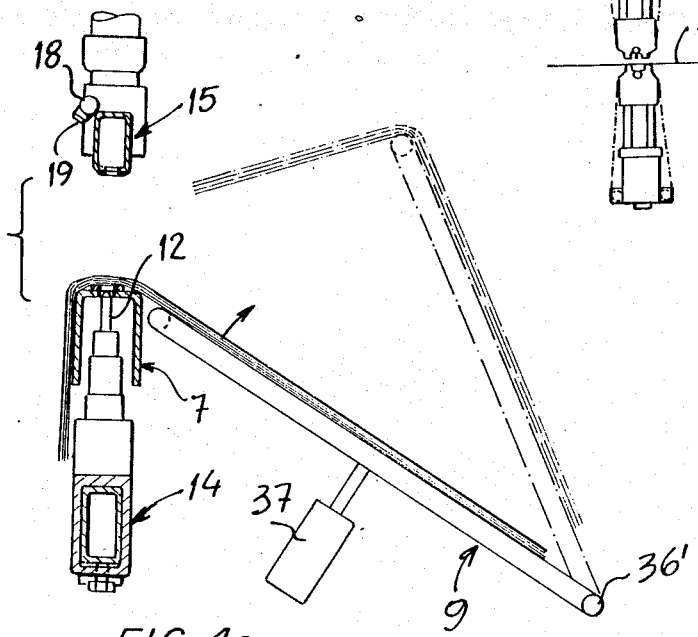

In the present invention, the bundling and ejector unit 6 (FIGS. 3 and 4) is comprised by a sealing table 7, made up by length of stock with an inverted "U" section, seated fixedly and transversally on frame 1 and interposed between a tilting vane 8 and a tilting table 9, the length of "U" section stock having a transverse branch thereof provided with a longitudinal groove 10, adjoining which are lateral and external rubber seats 11. and Through the seats extend preferably two sealing electrodes in the shape of pins 12, that perform the sealing of the various bags making up a block alongside of which are needles 13, to stabilize the bags on the table 7. Both, sealing electrodes 12 and needles 13 are seated on a support 14 which is capable of moving upwards or downwards to apply or withdraw the electrodes 12 and needles 13 from groove 10 on table 7. Above the latter, a corresponding depressing bar 15 formed by a length of stock with a rectangular section with the surface thereof facing table 7 is provided with a longitudinal groove 16 corresponding to groove 10 and adjoining which an external rubber seat 17 is also provided. The depressing bar 15 is movable upwardly or downwardly to urge the plastic film 2 against the sealing electrodes 12 and stabilizing needles 13. Upon the bar 15 a duct 18 is seated with various air-emitting nozzles 19 being turned toward the tilting vane 8 and which act in cooperation with the latter.

The tilting vane 8 is interposed between the input side of the sealing table 7 and the sealing and cutter unit 5, whereas the sealing table 9 is interposed between the opposite outlet side of the referenced table 7 and a support carrier 20. The tilting vane 8, when in a horizontal position, supports the plastic film 2 in the displacement thereof from the sealing and cutter unit 5 to the table 7 and, when it moves to a vertical position, it extracts a finished bag from the sealing and cutter unit 5. The finished bag is extracted from above the tilting vane 8 by jets of air coming from the air-emitting nozzles 19. The tilting table 9 is normally positioned slantingly and downwardly relative to the sealing table 7, in which position it supports the bags of a block of bags being formed and, upon completion of the forming of a block of bags, it moves angularly to throw it upon the support carrier 20, from where same is withdrawn by a machine operator, for the subsequent operations.

In greater detail, the sealing table 7 can operate in cooperation with more than one set of sealing electrodes 12 and stabilizing needles 13, seated on corresponding supports 14 and which work on respective tracks of bag-forming plastic film 2; the sealing table 7 having the extremities thereof provided with corresponding downward turned inverted "L"-shaped supports 21 whose free ends sustain a respective pneumatic cylinder 22, with the free end of the plunger 23 facing downward and supporting an orthogonal support 24, the free end of which is connected in a hingelike manner and through link 25 between the branches of a yoke 26 provided at each of the extremities of a bar 27, parallel to and below the table 7 and on which is seated the support 14 for the electrodes 12 and needles 13.

The support 14, in turn, is made up by a length of "U" section stock, whose free ends of the branches thereof support a base 28, on which are seated the sealing electrodes 12 and stabilizing needles 13. This length of stock has an intermediate cross member 29 reposing on bar 27, which, in its turn, bridges the branches length of stock and, further, with a leveling screw 30 being provided on the lower transverse branch of the latter, whose head extends outwardly from the referenced length of stock, the intermediate region working in the respective opening thereof and with the free end engaging the base 27, which screw, upon being tightened or loosened, enables the support 14 to be stabilized or displaced to a suitable position relative to the sealing table 7.

The depressing bar 15 has the free ends thereof connected in a hingelike manner and through links 31 between the branches of a support yoke 32 extending radially from a bushing 33, which is run through by the free end of a plunger 34 of a pneumatic piston 35, which free end of plunger is inside a coil spring 36, whose one extremity is against the bottom of the bushing 33 and other extremity against a flange of the referenced plunger 34, with the housing of the piston further being seated on the structure of the machine.

The duct 18 supporting the air-emitting nozzles 19 is connected to a source of air in the machine.

The tilting vane 8 is comprised by a plate, which is slightly above and parallel to the sealing table 7, having the side thereof, opposite to the one adjacent to the latter, integrally seated along a lower shaft 35', whose one end is connected to the movement transmission system of the machine.

The tilting table 9, in turn, is a surface whose lower extremity and opposite to the one adjacent to the sealing table 7 is seated in a hinge-like manner and through link 36' on any given surface and the intermediate region of the lower face thereof is connected to the end of the plunger of a pneumatic piston 37.

The support carrier 20, which operates in cooperation with the tilting table 9, is simply a carrier formed by a horizontal strut 38, which is parallel to the sealing table 7 and supported by vertical struts 39.

The machine for manufacturing wrappers, thus constructed, operates according to the following description:

The plastic film, molded into a tube and with lateral and longitudinal bellowslike formations, i.e., a gusseted tubular plastic web, moves intermittently along frame 1 and, at each cessation of movement, the cutter unit performs two longitudinal cuts 40 on the lateral bellowslike region, whose extremities facing the film's direction of movement are interconnected by the line of perforations 41, the longitudinal cuts 40 defining lateral strips 42 to form the future straps of the bag and, in cooperation with the line of perforations 41, defining an intermediate region 43, in which a central and rectangular peripheral sealing area 44 is provided, defined by the aforesaid line of perforations 41 and a "U"-shaped line of perforations 45; the central and rectangular peripheral area receiving the sealing operation to interconnect adjacent bags in forming a block of bags and the cited intermediate region being detached upon completion of the manufacture of the block of bags.

Simultaneous to the movement of the aforementioned cutter unit 4, the sealing and cutter unit 5 performs a transverse seal, which closes off the bottom of a bag that begins to be produced, parallel to which it performs a cut 47, that separates the bag that begins to be produced from a bag that is finishing being produced and more parallel to said cut 47 produces a seal 48, which joins the opposite sections of the straps 42 of the referenced bag which is finishing being produced.

Simultaneous to the action of the cutter unit 4 and sealing and cutter unit 5, the bundling unit 6 seals the aforementioned bag which is finishing being produced to the block of bags which is being formed and, for this to happen, the bag which is being finished remains with the sack-shaped section thereof on the block of bags which is being formed on the tilting table 9, the sealing area 44 and region of the intermediate area 43 adjacent to the latter on the sealing table 7 and with straps 42 and region 43 intermediate to same extended over the tilting plate 8 in the horizontal position up to the sealing region of the sealing and cutter unit 5, somewhat advanced relative to the downward movement of the latter and, under the action of cylinders 35, the depressing bar 15 descends upon the aforementioned sealing area 44 and region of the area 43 adjacent·to the the latter and depresses the referenced sealing area 44 and region of the area 43 adjacent to the latter, respectively, against the sealing electrodes 12 and stabilizing needles 13, thus promoting connection of the newly formed bag to the block of bags being formed. Even before the depressing bar 15 returnes to its former suspended position, the extractor vane 8 moves angularly and downwardly to extract the extremity of the straps of the bag from the sealing and cutter unit 5 and then the air-emitting nozzles 19 let out a jet of air that removes the bag from the vertically positioned tilting extractor vane 8. Thereafter, the extractor vane 8 returns to its original position, the same occurring with the bar 15 and the plastic film 2 is again advanced so that the bag that began to be produced in the previous operation can now be finished and a new bag can begin to be produced.

These movements repeat until the number of bags required for a block of bags is completed. When this occurs and after the sealing electrodes 12 and stabilizing needles 13 have acted upon the plastic film 2, the support 14, sustaining the said sealing electrodes 12 and needles 13, moves downwardly, due to the action of piston 22, causing the sealing electrodes 12 and stabilizing needles 13 to withdraw from the now formed block of bags. Then the tilting table 9, due to the action of piston 37, moves angularly to throw the block of now formed bags onto the carrier support 20, from where it is removed by the machine operator for the subsequent operation of detaching the intermediate region 43 from the block of bags.

Thereupon, the support 14 again moves upwardly, causing the sealing electrodes 12 and stabilizing needles to once more cross the longitudinal groove 10 in the sealing table 7 and the operation again repeats to form a new block of bags.

The support 14 may be disposed in any position throughout the sealing table 7 and, accordingly, all that is needed is to loosen the leveling screw 30 and to move the said support along the bar 27, to the desired position and, thereupon, to once again tighten the leveling screw 30.

Evidently, the various parts of the machine are interconnected through suitable mechanisms to begin to operate at an opportune moment in the manufacturing process.

I claim:

1. In a machine for making a unitized stack of vest type bags from a tubular web of plastic film comprising, essentially, a horizontal frame, adjoining one of the extremities of which is a unit for unwinding the plastic film, the frame supporting, at the intermediate portion, means comprising transverse rollers for pulling the plastic film and cutting means for cutting the film to define straps and a joining area of the bags, and a sealing and cutter unit being provided at the opposite extremity of said frame to effect transverse seals for closing the bottom and interconnecting the straps of bags being formed in adjacent sections of the plastic film, and to effect transverse cuts for separating adjacent bags and, at the outlet of said sealing and cutter unit, there being provided a bundling and ejector unit for joining a plurality of bags to form a block and for ejecting the then finished block, the improvement comprising the bundling and ejector unit (6) having a sealing table (7), made up by a length of stock with an inverted "U" section, seated fixedly and transversely on the frame (1) and interposed between a tilting vane (8) and a tilting table (9), said length of "U"-section stock having a section thereof provided with a groove (10), adjoining which are lateral and external rubber seats (11) and through which extend one or more sealing electrodes in the shape of pins (12) that perform the joining of the plurality of bags making up a block and alongside of which are needles (13) to stabilize the bags on the sealing table (7), both sealing electrodes (12) and needles (13) being seated on a support (14) for moving upwards or downwards to apply or to withdraw said electrodes (12) and needles (13) from said groove (10) on the sealing table (7) and there being, above the latter, a corresponding depressing bar (15) formed by a length of stock with a rectangular section with the surface thereof facing the sealing table (7) being provided with a longitudinal groove (16) corresponding to groove (10) on the latter and adjoining which an external rubber seat (17) is also provided, said depressing bar (15) moving vertically for urging the plastic film (2) against the sealing electrodes (12) and stabilizing needles (13) and upon which a duct (18) is seated with a plurality of air-emitting nozzles (19) being turned toward the tilting vane (8) and which act in cooperation with the latter, the tilting vane (8) being interposed between the sealing table (7) and the sealing and cutter unit (5), whereas the tilting table (9) is interposed between the referenced sealing table (7) and a support carrier (20), the tilting vane (8) being in a horizontal position for, supporting the plastic film (2) in the displacement thereof from the sealing and cutter unit (5) to the table (7) and moving to a vertical position for extracting a finished bag from the sealing and cutter unit (5), which finished bag is extracted from above the tilting vane (8) by jets of air coming from the air-emitting nozzles (19), with the tilting table (9) being positioned slantingly and downwardly relative to the sealing table (7) and for supporting a block being formed and moving angularly for throwing a then formed block onto the support (20).

2. A bag making machine, according to claim 1, characterized in that the sealing table (7) may operate in cooperation with more than one set of sealing electrodes (12) and stabilizing needles (13), seated on corresponding supports (14) and which work on the respective track of the bag-forming plastic film (2); said sealing table (7) having the extremities thereof provided with corresponding downward turned inverted "L"-shaped supports (21) whose free ends sustain a respective pneumatic cylinder (22), with the free end of the plunger facing downward and supporting an orthogonal support (24), the free end of which is connected in a hingelike manner and through link (25) between the branches of a yoke (26) provided at each of the extremities of a bar (27), parallel to and below the table (7) and on which is seated the support (14) for the electrodes (12) and stabilizing needles (13).

3. A bag making machine, according to claim 1 or 2, characterized in that the support (14) for the sealing electrodes (12) and stabilizing needles (13) is made up by a length of "U" section stock, whose free ends of the branches thereof support a base (28), on which are seated the sealing electrodes (12) and stabilizing needles (13), this length of stock having an intermediate cross member (29) reposing on bar (27), which, in turn, bridges the branches of said length of stock and, further, with a leveling screw (30) being provided on the lower transverse branch of the latter.

4. A bag making machine, according to claim 1, characterized in that the depressing bar (15) has the free ends thereof connected in a hingelike manner and through links (31) between the branches of a support yoke (32) extending radially from a bushing (33), which is run through by the free end of a plunger (34) of a pneumatic piston (35), which free end of plunger is inside a coil spring (36), whose on extremity is against the bottom of the bushing (33) and the other extremity against a flange of the referenced plunger (34), with the housing of said piston further being seated on the structure of the machine.

* * * * *